US006488222B1

(12) United States Patent
West et al.

(10) Patent No.: US 6,488,222 B1
(45) Date of Patent: Dec. 3, 2002

(54) BAG DISPENSING SYSTEM AND C-FOLD BAG USED THEREWITH

(76) Inventors: Larry G. West, 14 Suffolk Downs Way, Greenville, SC (US) 29615; Charles Paul Kannankeril, 26 Wind Ridge Dr., North Caldwell, NJ (US) 07006

( * ) Notice: Subject to any disclaimer, the term of this patent is extended or adjusted under 35 U.S.C. 154(b) by 81 days.

(21) Appl. No.: 09/642,138

(22) Filed: Aug. 18, 2000

(51) Int. Cl.[7] ..... B65H 18/28

(52) U.S. Cl. ..... 242/160.4; 493/243; 493/238; 493/248; 383/7; 383/8; 383/109; 383/120

(58) Field of Search ..... 242/160.4, 428, 242/598.5, 598, 599.3, 422.5; 383/78, 9, 120, 121, 122, 37, 105, 109, 104; 206/554, 493, 820; 493/167, 195, 196, 243, 238, 244, 248

(56) References Cited

U.S. PATENT DOCUMENTS

| | | | | | |
|---|---|---|---|---|---|
| 2,819,834 | A | * | 1/1958 | Brady | 383/120 |
| 3,670,953 | A | * | 6/1972 | Leventhal | 383/109 |
| 3,670,954 | A | * | 6/1972 | Leventhal | 383/109 |
| 3,758,024 | A | * | 9/1973 | Bethke et al. | 383/120 |
| 4,508,222 | A | * | 4/1985 | Choe | 383/120 |
| 4,759,742 | A | * | 7/1988 | Achelpohl | 383/120 |
| 4,846,349 | A | * | 7/1989 | Galimberti | 493/194 |
| 5,192,133 | A | * | 3/1993 | Jule et al. | 383/109 |
| 5,219,424 | A | * | 6/1993 | Simhaee | 225/106 |
| 5,261,585 | A | * | 11/1993 | Simhaee | 225/106 |
| 5,556,019 | A | * | 9/1996 | Morris | 225/106 |
| 5,890,810 | A | * | 4/1999 | Barlow | 383/120 |
| 5,934,535 | A | * | 8/1999 | Kannankeril et al. | 225/106 |
| 6,135,281 | A | * | 10/2000 | Simhaee | 383/120 |
| 6,159,136 | A | * | 12/2000 | Belias et al. | 493/194 |
| 6,254,520 | B1 | * | 7/2001 | Angless | 493/243 |

* cited by examiner

*Primary Examiner*—William A. Rivera

(57) ABSTRACT

A folded gusseted plastic bag has a first side gusset formed by first, second, and third longitudinal folds, a second side gusset formed by fourth, fifth, and sixth longitudinal folds, a seventh longitudinal fold being on a side of the bag containing the first, second, and third folds and forming a first folded bag flap, and an eighth longitudinal fold which is on a side of the bag containing the fourth, fifth, and sixth folds, the eighth fold forming a second folded bag flap. The folded gusseted bag also is folded into a total of at least eight contiguous plies. A roll of the folded, gusseted bags includes a continuous web of the folded, flattened bags joined along perforated severance lines. Preferably the perforated severance lines further comprise a centrally-located slit. The dispensing system utilizes the roll of folded-gusseted bags in combination with a dispenser comprising: (i) a support member for attachment to a support surface; (ii) a pair of guide channels carried by the support member for rotatably supporting the roll of plastic bags for rotation of the roll on the core; (iii) a tongue spaced apart from and carried by said support member in a predetermined position corresponding to the predetermined position of the slit in the tear line.

8 Claims, 4 Drawing Sheets

FIG. 4C
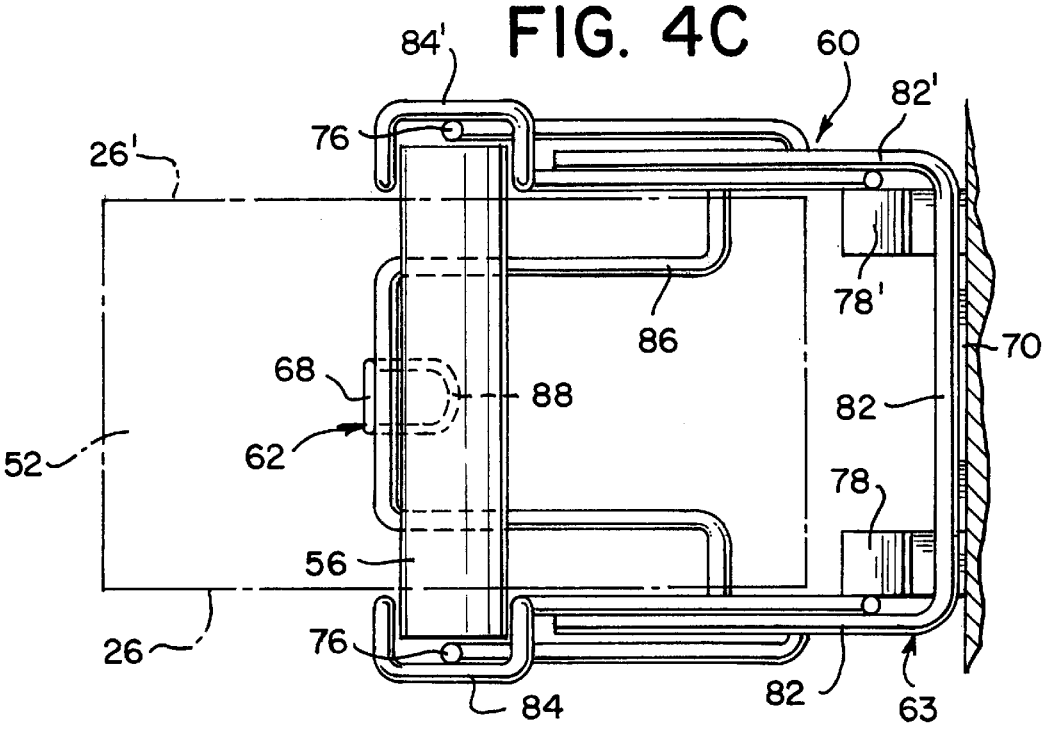
FIG. 5
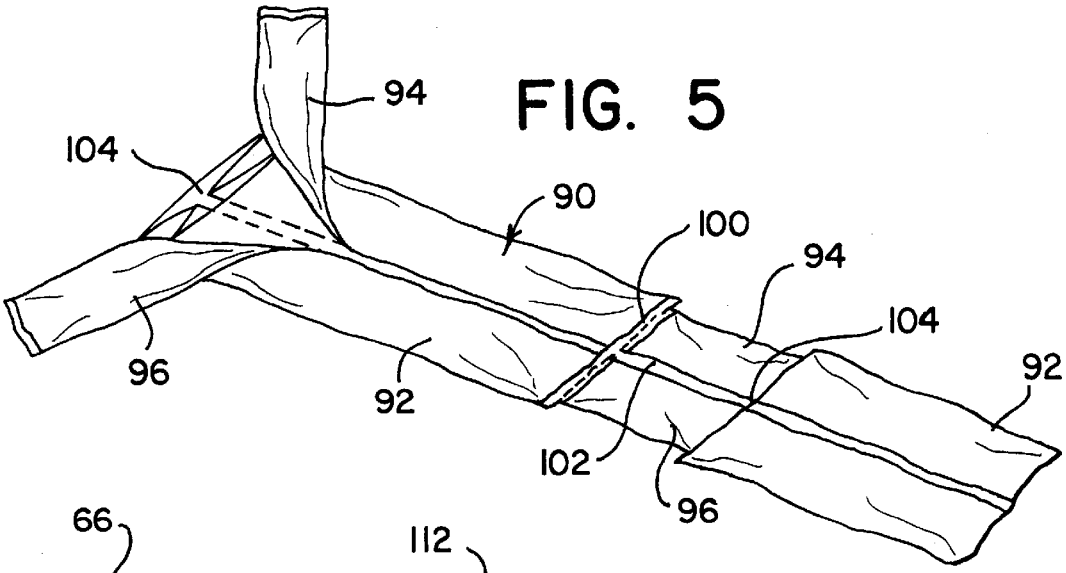
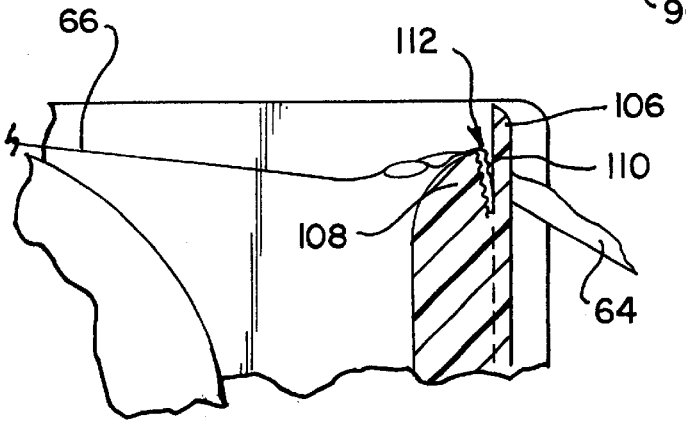
FIG. 6

BAG DISPENSING SYSTEM AND C-FOLD BAG USED THEREWITH

FIELD OF THE INVENTION

The present invention relates to a folded plastic bag, a roll of folded plastic bags, and a bag dispensing system employing the roll of folded plastic bags in a dispenser.

BACKGROUND OF THE INVENTION

In recent years, various systems for dispensing bags have been developed, these systems providing a mechanism for dispensing bags from a roll of continuous bags separated from one another by a line comprising perforations and a slit. The dispensing system employs a tongue to assist a user in separating the bag to be dispensed from the next bag on the roll, i.e., the adjacent upstream bag. More particularly, when the roll of continuous bags is unrolled so that a slit between two bags snags on the upstanding tongue member, the user continues to pull, causing the downstream bag to be separated from the adjacent upstream bag by tearing across the line of perforations until the bags are completely separated.

The bags used in such bag dispensing systems have been bags having star seals and eight contiguous plies, with a slit through all eight contiguous plies. These bags are somewhat difficult to open because the device which cuts the perforations and slits tends to cause "micro welding" of the contiguous plies to one another. The difficulty in opening the bags is also due to the narrow width of the bags. Various means to improve the opening of the star seal bags have been devised. However, these methods have involved some form of treatment of the perforations and slit, or treatment of the film from which the star sealed bag is made.

SUMMARY OF THE INVENTION

This invention provides a bag which is easier to open because it has folds along each edge which can readily be unfolded upon dispensing of the bag. As a result, opening the bag requires separation of only half of the number of plies of the star seal bag of the prior art. In addition, the manner in which the bag is folded allows the bag to be sealed so that the seal has a strength comparable to a star seal. Moreover, the folded bag can be rolled onto a core, with the resulting roll of bags having a width suitable for plastic bag dispensers in current commercial use.

As a first aspect, the present invention is directed to a bag dispensing system comprising a roll of plastic bags and a dispenser. The roll of plastic bags comprises a continuous web of folded, lay-flat, end-seal bags separated by a perforated separation line including a slit. The bags further comprise: (i) first, second, and third longitudinal folds which form a first gusset; (ii) fourth, fifth and sixth longitudinal folds which form a second gusset; (iii) a seventh longitudinal fold which is on a first half of the bag which contains the first, second, and third folds, the seventh fold forming a first folded bag flap; (iv) an eighth longitudinal fold which is on a second half of the bag which contains the fourth, fifth, and sixth folds, the eighth fold forming a second folded bag flap. Each bag is folded into a total of at least eight contiguous plies, with the slit being through all of the plies, or through less than all of the plies.

The dispenser comprises: (i) a support member for attachment to a support surface; (ii) a pair of guide channels carried by the support member for rotatably supporting the roll of plastic bags for rotation of the roll on the core and having an open end for receiving said core; (iii) a tongue spaced apart from and carried by said support member in a predetermined position corresponding to the predetermined position of the slit in the tear line. The roll of plastic bags is in direct contact with the dispenser at a braking point on the dispenser, with the roll of bags being positioned in the dispenser so that upon pulling a bag to be separated, the slit catches on the tongue, with further pulling causing the bag to be separated to tear free of the adjacent bag. Preferably, the bags are rolled so that the flaps are positioned inward of a remainder of the bag, i.e., positioned toward the axle upon which the bags are rolled. Preferably, the bags are symmetrically folded.

In this dispensing system, the plastic bags are wound on a core (i.e., an axle). The core having end portions which extend from the roll of bags, with the dispenser further comprising a pair of guide channels carried by the support member for rotatably supporting the roll of plastic bags for rotation of the roll on the core, the guide channels having open ends for receiving the extending end sections of the core. The guide channels hold the extending portions of the core for rotational and translational movement therewithin as the bags are individually dispensed from the roll. The roll of plastic bags is in direct contact with the dispenser at a braking region on the dispenser, to prevent an undesirable degree of freewheeling of the roll of bags during and after dispensing.

Alternatively, the invention is useful on other types of dispensers as referred to herein. As such, the roll of plastic bags can be coreless, have a solid core with ends which either extend from the planar sides of the roll of bags or which are flush with the planar sides of the roll of bags. If coreless, the roll of bags can be solid (i.e., without a hollow center), or can have a hollow center useful for hanging the roll on a dispenser.

As to the roll of bags, preferably the bags are interconnected as a strand, with successive bags being connected to one another via a line of perforations and a slit. Preferably, the slit is centrally-located. Preferably, the separation line further comprises perforations, i.e., in addition to the slit. The slit can be through just two plies, through four plies, or even through eight plies. The slit can be transverse, i.e., across the length of the bag, or can be parallel to the side edges of the bag, i.e., along the length of the bag. Preferably, the gussets do not contact one another.

The slit can be in a direction transverse to a length of the bag. Alternatively, the slit can be in a direction parallel to the length of the bag. Regardless of the slit orientation, in some preferred embodiments the flaps may not overlap one another; in other preferred embodiments, the flaps overlap one another.

In one preferred embodiment, each side of the bags has eight contiguous plies with all eight contiguous plies being sealed to one another. In this embodiment, the flaps preferably overlap one another. Preferably, the plastic bags are folded so that they have a total of eight plies on each side of the bag, and preferably, all eight plies are sealed to one another.

In an alternative preferred embodiment, the bags have four contiguous plies sealed together, with flaps not sealed to a remainder of the bag. In this alternative embodiment, the flaps preferably overlap one another.

Although the bag may be made from a monolayer film or a multilayer film, preferably the bag is made from a monolayer film. Although any thermoplastic, film-forming polymer may be used for the bag, preferred polymers include polypropylene, polyethylene homopolymer, polyethylene copolymer, polystyrene, polyamide, and polyester. More preferably, the bags comprise high density polyethylene (HDPE), low density polyethylene (LDPE), linear low density polyethylene (LLDPE), very low density polyethylene (VLDPE), and single site catalyzed polymers (preferably linear homogeneous ethylene/alpha-olefin copolymer or substantially linear homogeneous ethylene/alpha-olefin copolymer having long chain branching). Preferably, the bags are made from a 100% HDPE. Other preferred polymers include polypropylene, low density polyethylene, linear low density polyethylene, very low density polyethylene, and single site catalyzed (preferably linear homogeneous ethylene/alpha-olefin copolymer or substantially linear homogeneous ethylene/alpha-olefin copolymer having long chain branching. Preferred polymer blends include blends of HDPE with LLDPE (5–20 weight percent) and HDPE with LDPE (5–20 weight percent). HDPE is the preferred polymer for use in making the bag film.

Preferably, the film from which the bag is made is a monolayer film. Preferably, the film has a thickness of from 0.1 to 3; more preferably, 0.2 to 1.5 mils; and still more preferably, about 0.3 mil.

The bag in the open position, i.e., when in use, may vary in lay-flat width but is about 14 inches wide lay-flat. Preferably, the bags on the roll are folded so that they each have a width of from about 1 to 7 inches; more preferably, from about 3 to 6 inches; still more preferably, from about 3 to 5 inches; yet still more preferably, about 33/4 inches. Preferably, the axle is at about 1½ inches longer than the width of the roll.

Preferably, the roll of plastic bags is on an axle. Although the axle can be solid or hollow, preferably the axle is hollow. Preferably, the axle is longer than the roll is wide. Preferably, the core has a width of from about 2 inches to about 8 inches; more preferably, from about 4 to 6 inches; still more preferably, from about 4 to 5½; yet still more preferably, about 5¼ inches. Preferably, the axle is at about 1½ inches longer than the width of the roll. Alternatively, the roll of bags can be coreless, with either a hollow center or as a cylindrical roll without a hollow center.

Preferably, the film is corona treated, at least in the area to be printed, as the corona treatment enhances film-to-ink adhesion. In addition, corona treatment imparts a static charge to the bags, increasing bag-to-roll cling, which can be advantageous for the roll of interleaved bags. Finally, corona treatment can make the bag easier to open, in that interply fusion is produced at the open end of the bag by the perforation and slitting. It has been found that the application of corona treatment to the film before slitting and perforating diminishes the fusion from the perforation and slitting, resulting in a bag which is easier to open.

Preferably, the bags have printing on an outside surface thereof, and preferably the printing is confined to a central region on one or both outside plies, with no printing along edge regions with contact the brake plates. More preferably, the printing is confined to the outside surface most visible to the consumer as the bag is being dispensed.

Preferably, the dispenser comprises a brake plate disposed for contact with an outer surface of the roll of bags, the brake being positioned at an acute angle to the direction of translational movement of the core for at least a portion of the translational movement of the core while the core is within the guide channels. Preferably, the brake is present in the form of a pair of narrow brake plates which are positioned to contact outer edges of the roll of bags. Preferably, the brake plates have the same width. Preferably, the brake plates together contact from about 1 to 40 percent of the width of the bag roll; more preferably, from about 5 to 30 percent; still more preferably, from about 10 to 25 percent. Preferably, the dispenser provides a brake point which changes as the roll is depleted.

Preferably, each of the guide channels in the dispenser has an open top and a closed bottom. Preferably, at least a portion of the dispenser is made from wire; preferably, the wire comprises stainless steel. Preferably, the dispenser further comprises a pair of axle constraining members which are spaced wider apart from each other at the open ends of the guide channels than at the closed ends of the guide channels.

As a second aspect, the present invention is directed to a roll of bags for use with a dispenser which dispenses and separates a plastic bag from a roll of plastic bags. The dispenser has a support member for attachment to a support surface and a pair of guide channels carried by the support member for rotatably supporting the roll of plastic bags, a surface which is engageable by the roll of bags when the roll of bags is supported in the guide channels. The improvement comprises a roll of plastic bags wound on the axle, the plastic bags being in the form of a flattened tubular member having at least four contiguous plies, the roll being rotatable with the axle, the axle being axially longer than the roll is wide, with the ends of the axle projecting beyond the ends of the roll a distance sufficient to enable the axle to be supported for rotational and translational movement in the guide channels in such a way that the roll of bags frictionally engages the dispenser at a braking point on the dispenser. The bags are present in the form of a continuous chain of folded, lay-flat, end-seal bags separated by a separation line including a substantially centrally-positioned slit. The bags comprise: (A) first, second, and third longitudinal folds which form a first gusset; (B) fourth, fifth and sixth longitudinal folds which form a second gusset; (C) a seventh longitudinal fold which is on a side of the bag containing the first, second, and third folds, the seventh fold forming a first folded bag flap; (D) an eighth longitudinal fold which is on a side of the bag containing the fourth, fifth, and sixth folds, the eighth fold forming a second folded bag flap. The folds result in each bag being folded into a total of at least eight contiguous plies. The folding and cutting are carried out so that each bag has a total of at least eight contiguous plies, with the slit being through all of the plies, or through less than all of the plies. When a continuous web of such bags are rolled up to form a roll of bags, although either side of the continuous web of folded bags can face outward on the roll, preferably the web is rolled up with the flaps positioned beneath the remainder of the bag, i.e., the flaps being closer to the center of the roll, i.e., facing inward, rather than being present on the outside of the roll. In this manner, the flaps are "contained" within the roll by the remainder of the bag. However, if the flaps overlap one another, preferably the flaps should be facing outward, exposing the slit below for the tongue to directly engage, i.e., without having the overlapping flaps blocking the tongue from penetration of the slit.

BRIEF DESCRIPTION OF THE DRAWINGS

FIG. 4C illustrates a top view of the bag dispensing system illustrated in FIG. 4A.

FIG. 5 illustrates a portion of a set of alternative plastic bags in accordance with the present invention, wherein the bags are handle bags, with the handles of the end bag being partially unfolded; the handle bags of FIG. 5 are to be provided in roll form (e.g., as illustrated in FIG. 3), with the roll optionally containing an axle which can be solid or tubular; the ends of the core can be flush with the roll of bags or can extend from the roll of bags; if flush, the core is preferably hollow.

FIG. 6 illustrates a side view of a tongue-and-finger combination which can be used on the dispensers illustrated in FIGS. 4A, 4B, and 4C.

DETAILED DESCRIPTION OF THE INVENTION

As used herein, the phrase "end-seal bag" is used with reference to a bag comprising a segment of a seamless, tubular film having a seal thereacross which forms the bottom of the bag. The seal can be at or near the bottom edge of the bag. A heat seal is preferred, and an impulse heat seal is a preferred end seal. The bag can be sealed while in an unfolded lay flat configuration or while in a folded lay-flat configuration.

As used herein, the phrase "side of the bag" is used with reference to folded bags to refer to that portion of the folded bag which extends from a central axis of the bag to a side edge of the bag. For example, gussets and flaps which run the length of the bag can be present on both "sides" of the bag, or on only one "side" of the bag. For example, a vertically-hung, folded (i.e., lay-flat) bag, when viewed from a lay-flat side, has a longitudinal central axis which is vertically oriented, with one "side" of the folded bag being that entire portion of the folded bag which is located from the longitudinal axis to the left side edge of the bag, and the other "side" of the folded bag being that entire portion of the bag from the axis to the right side edge of the bag.

Figure 1:
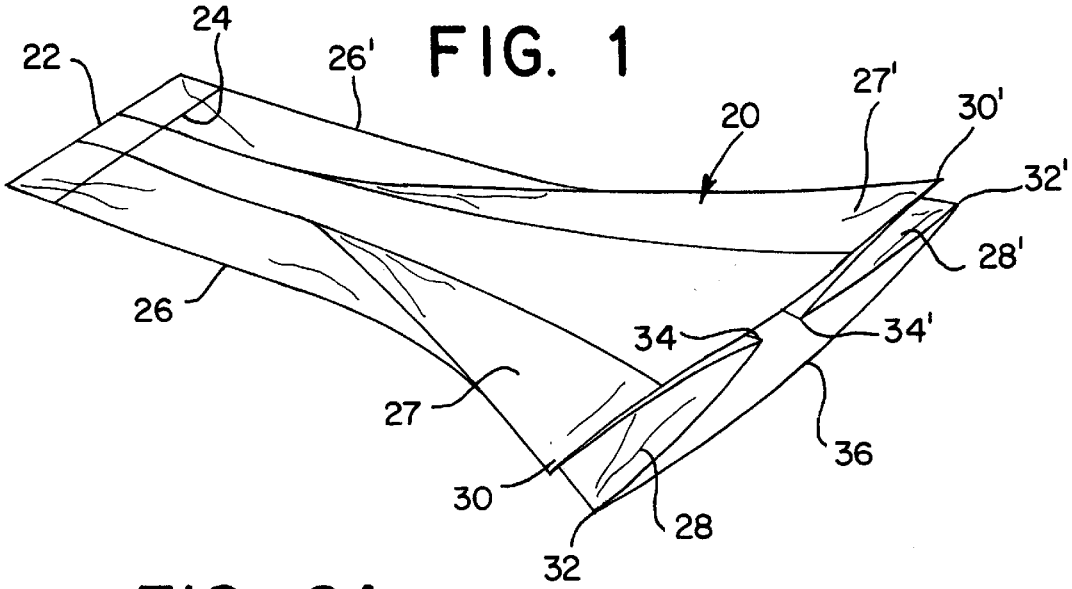
FIG. 1 is a perspective view of a partially unfolded plastic bag in accordance with the folded plastic bag of the present invention.

FIG. 1 illustrates a partially unfolded perspective view of preferred folded plastic bag 20 in accordance with the present invention. The folded bag is herein termed as having a "C-fold". This description is based on the folding over of flaps on each side of the bag, as described below.

Folded plastic bag 20 has bottom end 22, transverse heat seal 24, folded bag side edges 26 and 26' formed by a pair of lengthwise folds, gussets 28 and 28', gusset folds 30, 30', 32, 32', and 34, 34', and an open top having top edge 36. Together, there are a total of six gusset folds (3 folds forming each gusset), with an additional two folds making up the two flaps 27 and 27'. Side edges 26 and 26' are formed by folding each gusset over so that flaps are formed. That is, the longitudinal folding over of a portion of the gusset on a first side of the bag (i.e., the gusset formed by folds 30, 32, and 34), forms first side edge 26 and the first flap. Likewise, the longitudinal folding over of a portion of the gusset on a second side of the bag (i.e., the gusset formed by folds 30', 32', and 34'), forms second side edge 26' and the second flap.

Figure 2A:
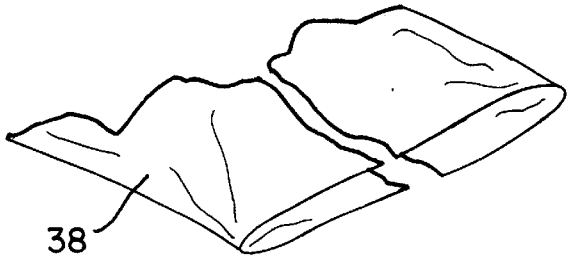
FIGS. 2A, 2B, 2C, and 2D illustrate various stages in converting a seamless plastic film tubing into a set of interconnected folded plastic bags of the present invention.

FIGS. 2A, 2B, 2C, and 2D illustrate various steps involved in a preferred process for converting a seamless tubing to the folded plastic bag 20 of FIG. 1. FIG. 2A illustrates seamless plastic tubing 38 in a lay-flat configuration, which is the starting point for making folded plastic bag 20. Seamless plastic tubing 38 is preferably produced by extrusion through an annular die, preferably as a melt blown film in which the annular extrudate is oriented while molten, i.e., before solidification. As a result, seamless plastic tubing 38 preferably has little, if any, heat shrink character. Preferably, seamless tubing 38 has a lay-flat width of about 14 inches.

Figure 2B:
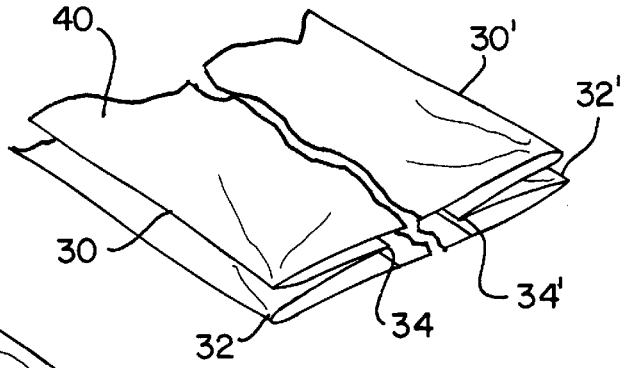

FIG. 2B illustrates a gusseted tubing 40 having a first gusset formed by folds 30, 32, 34 on a first side of the tubing, with corresponding second gusset formed by folds 30', 32', and 34' on a second side of the tubing. The edges of seamless tubing 38 (FIG. 2A) are converted into gusseted tubing 40 (FIG. 2B) by tucking the edges of lay-flat seamless tubing 38 inwardly, resulting in the various folds in gusseted tubing 40. Preferably, gusseted tubing 40 has a lay-flat width of about 6½ inches. Preferably, each of the gussets are about 3¼ inches deep, with the gussets not quite touching one another, i.e., with a space of about 1/16 inch between folds 34 and 34'.

Figure 2C:
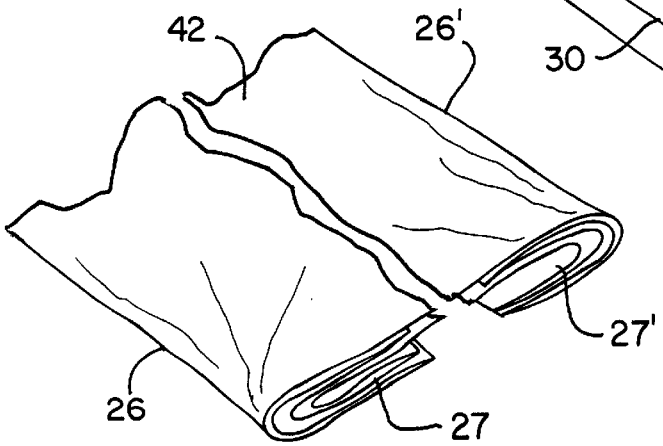

FIG. 2C illustrates the next step in the making of the folded plastic bags, in which folded gusseted seamless tubing 42 is formed by making lengthwise folds of the two gusseted portions of gusseted tubing 40 of FIG. 2B, i.e., forming side edges 26 and 26', and forming flaps 27 and 27' from portions of the gusseted portions of the tubing. Folded gusseted seamless tubing 42 preferably has a width of about 3¾ inches, with each flap having a width of only 1⅜ inches, leaving about a 1 inch gap between the flaps.

Figure 2D:
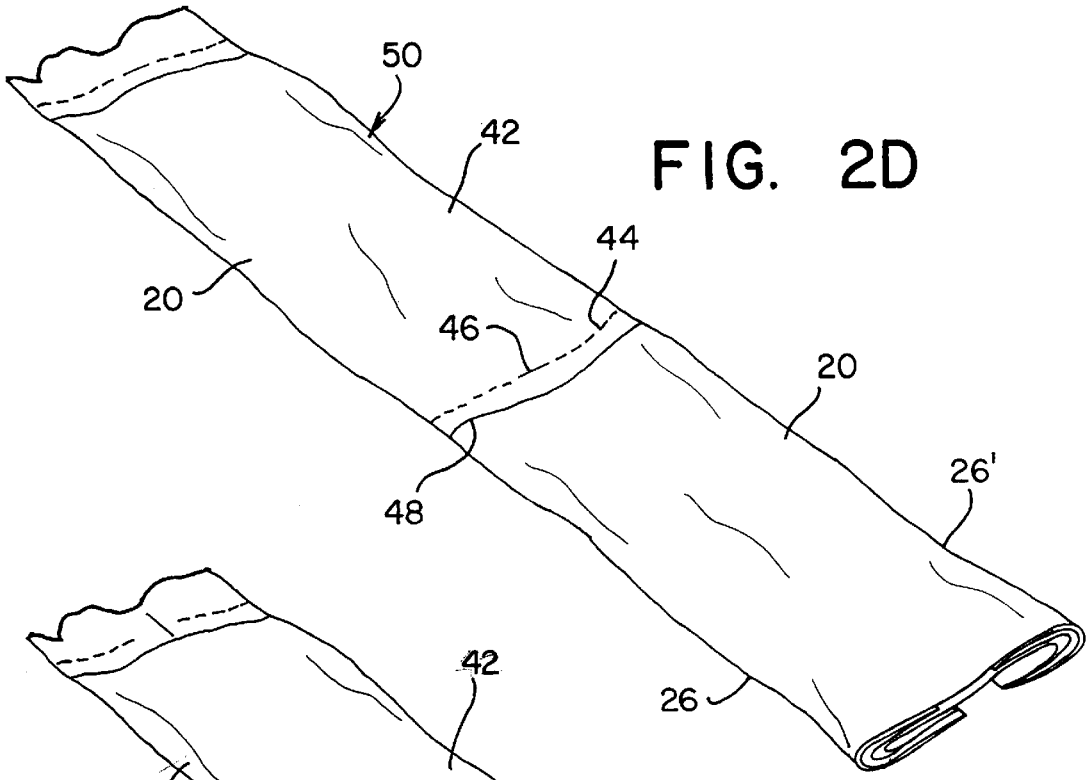

FIG. 2D illustrates a further step in the process of producing folded plastic bag 20 of FIG. 1. More particularly, at desired intervals, transverse perforations 44 (having an enlarged central-located perforation, herein referred to a slit 46) and transverse heat seal 48 are made directly across folded gusseted seamless tubing 42 of FIG. 2C, resulting in a continuous strand 50 containing a series of interconnected gusseted folded plastic bags. The distance between the heat seal and the perforations is preferably about ¼ inch. The heat seal is preferably an impulse heat seal, and is made through eight plies of plastic film. The line of perforations 44 is downstream of its associated heat seal 48. When a tear is made across the line of perforations, the tear forms the bottom edge of the bag downstream of the line or perforations, and the top edge of the bag upstream of the line of perforations. Preferably, slit 46 has a length of about 1 inch. Preferably, slit 46 is through four plies of film, as the folded flaps are not brought closer than one inch to one another.

Figure 2E:
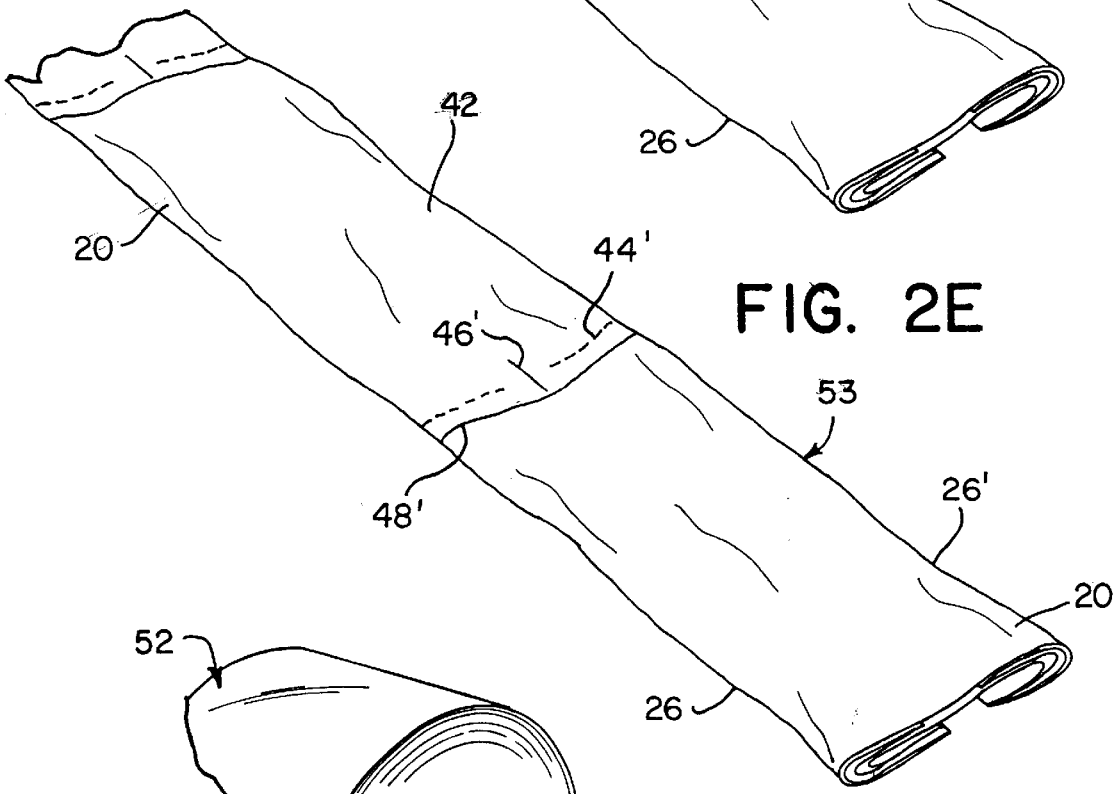
FIG. 2E illustrates an alternative embodiment relative to the interconnected folded plastic bags of FIG. 2D.

Preferably, the folding, sealing, and cutting of tubing 38 is carried out continuously, forming a continuous strand 50 of interconnected folded bags 20, each separated from neighboring folded bags by perforations 44 and centrally located slit 46, as illustrated in FIG. 2D. As can be seen in FIG. 2D, centrally-located slit 46 is located within the line of perforations 44, i.e., transverse to the length of folded bag 20. Alternatively, as illustrated in FIG. 2E, slit 46' is oriented along the length of folded bag 53, and extends from a point downstream of line of perforations 44' upstream to line of perforations 44', adjacent heat seal 48'. Either alternative of slit orientation is operable, together with other variations on the location and orientation of slits 46 and 46'.

The embodiment of FIG. 2E provides the advantage that the slit can avoid cutting through both gussets even though the gussets extend inward and almost touch one another, i.e., by providing a slit 46' in a direction parallel to the length of the bag (i.e., a "machine-direction slit"), as schematically illustrated in FIG. 2E. If a machine-direction slit 46' is used, the flaps can either be spaced from one another (in which case sealing can be performed after folds 36 and 36' are made); alternatively, flaps 27 and 27' can extend to touch or overlap one another, as discussed above, so long as sealing and cutting are performed prior to folding to form flaps 27 and 27' , as discussed above.

Although gussets 28 and 28' may meet and even cross over one another in the folded bag, in another embodiment gussets 28 and 28' are spaced apart from one another enough to prevent slit 46 from extending far enough to cut into either gussets 28 or 28'. That is, folds 34 and 34' are preferably kept apart from one another enough to avoid having slit 46 pass through either of gussets 28 and 28'. This can make it still easier to open bag 20 because there are only two films to separate in the region between gussets 28 and 28'. The separation of these two plies enables an easier separation of the remaining plies formed from the gussets and the additional lengthwise folding.

The folding of gusseted tubing 40 to form folded gusseted tubing 42 should be completed before cutting and sealing to form perforations 44, slit 46, and seal 48. If a wider bag is desired, the folds to form side edges 26 and 26' can be overlapped with one another, while retaining a relatively narrow roll width. On the other hand, it may result in a bag which is easier to open if the flaps are formed by folds which leave a gap between the flaps. In any event, it is preferred to complete the folding operations before perforating, slitting, and sealing across the gusseted, folded tubing, as the seal through eight contiguous plies provides a bag with a stronger bottom seal because more of the individual plies are sealed on both sides and because all of the plies are sealed together over a shorter distance.

An alternative sequence of operations can be used to produce a gusseted lay-flat bag in which the flaps are not sealed to the remainder of the folded bag. This process is carried out by first folding the tubing to form the gussets, followed by sealing across the gusseted tubing, followed by cutting to form the perforations and the slit, followed by the folding of the flaps. This alternative process can likewise be used to produce a continuous web of bags which can be dispensed from dispenser 63, because tongue 62 can readily pass between flaps 27 and 27'. In this way, a lay-flat tubing having a width of, say, 14½ inches can be gusseted so that it has an overall width of, say, 8¼ inches (each gusset having a width of about 3 and one eighth inches, leaving a 2 inch gap between the gussets), with the resulting gusseted tubing being folded to form two flaps each having a width of 3¾ inches, with each of the flaps having a width of 2¼ inches. This combination provides a bag made from a lay-flat tubing having a width of 14½ inches, which is the lay-flat width of the tubing used to make star sealed bags in current commercial dispensing systems. Moreover, since the sealing and cutting are performed before the final two folds (to produce the two flaps), the slit does not penetrate either of the folds, and does not penetrate any portion of either of the gussets if the slit is, say, less than 2 inches long and is centrally-positioned.

Figure 3:
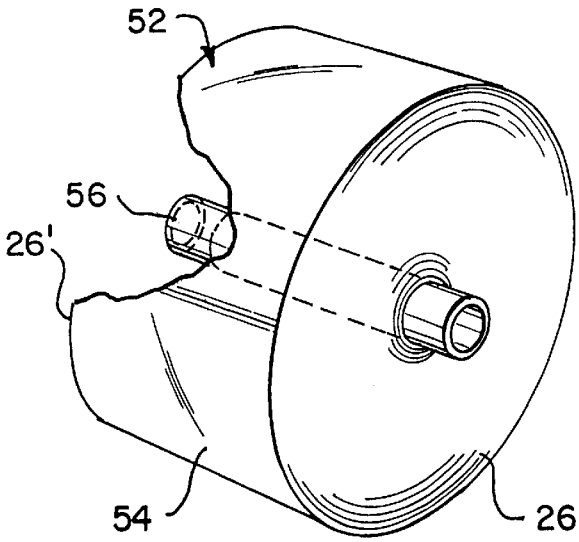
FIG. 3 illustrates a roll of plastic bags on an axle, with the roll of plastic bags containing folded plastic bags in accordance with the bags of the present invention.

FIG. 3 illustrates a perspective cutaway view of roll-of-plastic-bags 52. Roll-of-plastic-bags 52 has curved circumferential outer surface 54. Roll of plastic bags 52 is wound around tubular axle (i.e., hollow core) 56 which, in turn, has end portions which extend axially from roll-of-plastic-bags 52.

Figure 4A:
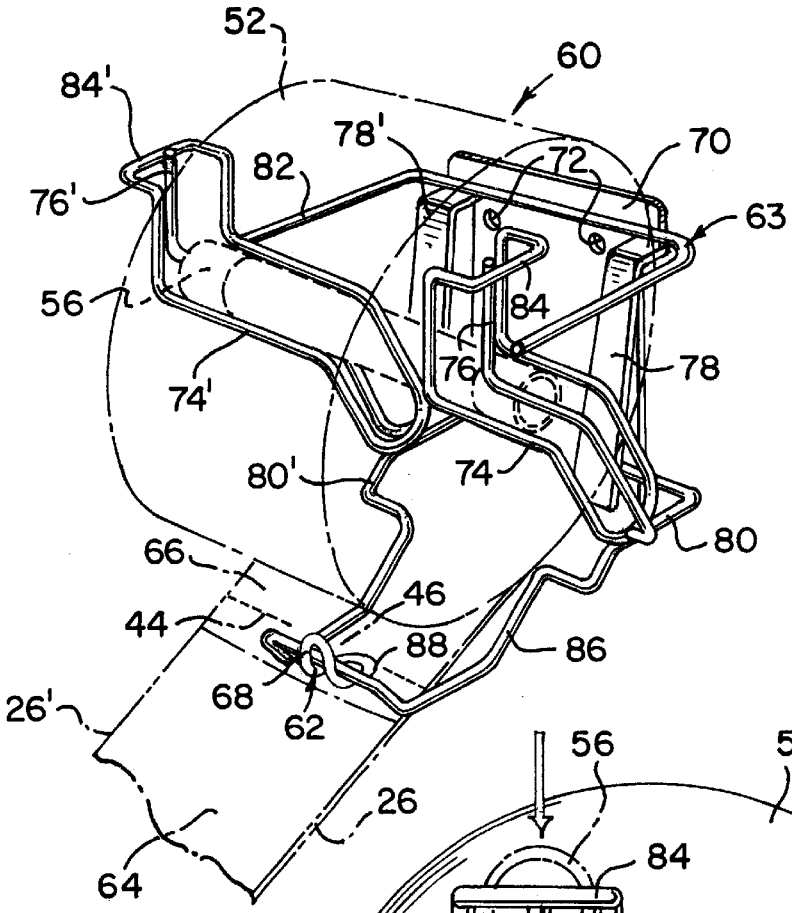
FIG. 4A illustrates a perspective view of a preferred bag dispensing system employing the roll of plastic bags illustrated in FIGS. 3 and 5.
Figure 4B:
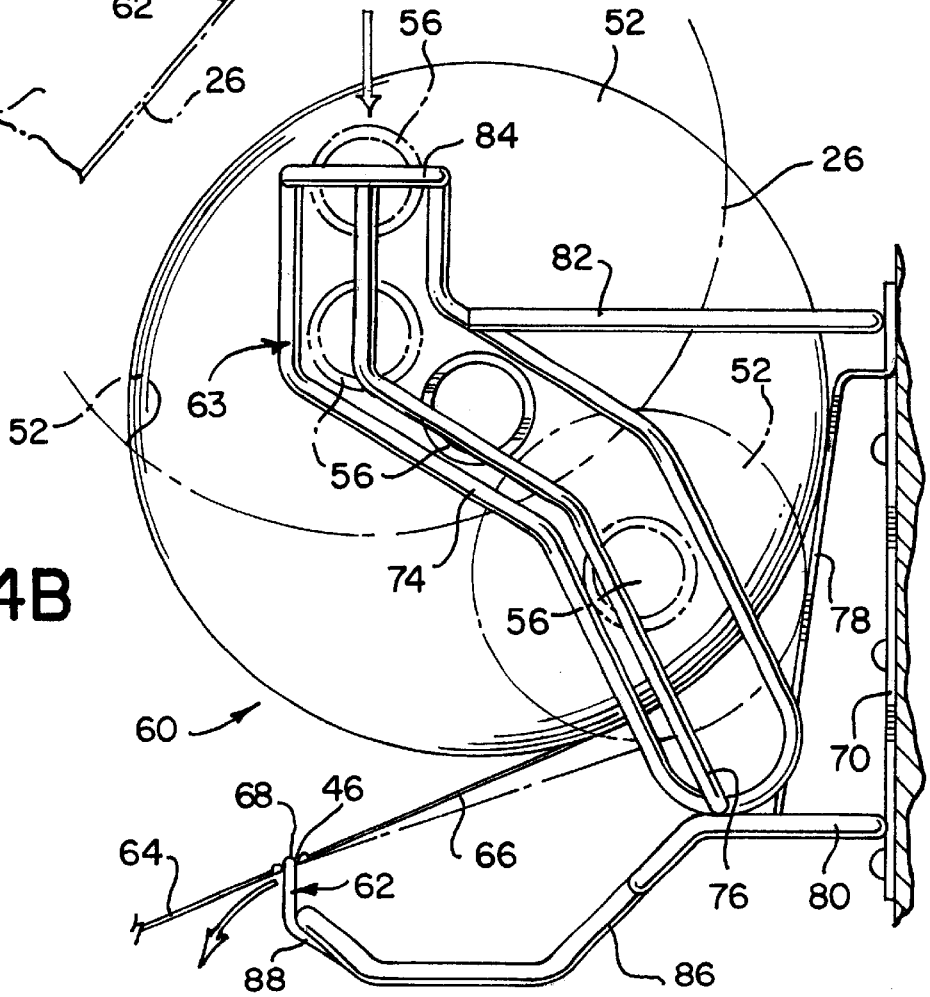
FIG. 4B illustrates a side view of the bag dispensing system illustrated in FIG. 4A.

FIGS. 4A, 4B, and 4C, illustrate a preferred bag dispensing system 60. FIG. 4A illustrates a perspective view of dispensing system 60, including preferred roll of plastic bags 52, i.e., as illustrated in FIGS. 3. As illustrated in FIGS. 4A, 4B, and 4C, bag dispensing system 60 includes dispenser 63 as well as roll of plastic bags 52 on axle 56.

Roll-of-plastic-bags 52 contains a continuous strand of interconnected folded plastic bags as a continuous web. More particularly, a bottom edge of downstream bag 64 is connected to the top edge of next upstream bag 66, i.e., connected thereto by a tear line having perforations 44 and slit 46 centrally positioned along the perforated tear line. That is, slit 46 is preferably centered with respect to the midpoint of the perforation line extending between side edges 26 and 26'.

As illustrated in FIG. 4A, slit 46 is caught on upper triangular tongue 68, so that continued pulling on first bag 64 results in tearing first bag 64 free from next-upstream bag 66. Thereafter, pulling on bag 66 causes roll-of-plastic-bags 52 to rotate until the slit between bag 66 and the next upstream bag (not illustrated) catches on upper triangular tongue 68, followed by continued pulling to tear off bag 66. Thereafter, successive bags are dispensed in like manner.

Bag dispenser 63 is preferably constructed so that it has an open structure, i.e., without substantial surfaces which can be exposed to food products, water, dirt and dust, etc. Preferably dispenser 63 is constructed from metallic wire, such as chrome plated wire, more preferably, stainless steel wire. Wires are aesthetically pleasing and also easy to clean, both of which are advantageous in the food industry. Bag dispenser 63 is preferably a welded stainless steel wire structure, preferably contains various wires having a diameter of from 3⁄16 inch to 5⁄16 inch. Preferably, all portions of dispenser 63 are made from stainless steel. This prevents rusting. Moreover, the open structure provides a rigid, durable framework which is less susceptible to accumulation of dust and dirt than a structure made from plate-like members which are either integrally molded or assembled from separate parts.

Bag dispenser 63 includes support member 70 for attachment to a support surface such as a wall or countertop. Support member 70 is preferably a thin metal plate with a plurality of holes 72 suitable for attaching dispenser 63 to a variety of surfaces, using fasteners such as screws, nails, brads, rivets, etc. Alternatively, support member 70 can be soldered, welded, brazed, etc. directly to any suitable support.

Bag dispenser 63 also has a pair of guide channels, each of which is formed from U-shaped wire or rod frame members 74 and 74'. U-shaped wire or rod frame members 74 and 74' are preferably shaped with two bends in the manner illustrated in FIGS. 4A and 4B. Dispenser 63 also has axle constraining members 76 and 76' to confine the axial movement of axle 56. Constraining members 76 and 76' are also designed to contact the ends of axle 56 as the roll becomes severely depleted, in order to increase frictional drag to prevent over-rotation of roll 52 during dispensing. Dispenser 63 is further provided with peripheral brake plate members 78 and 78' to reduce or eliminate roll freewheeling during dispensing of the bags from bag dispensing system 60.

As stated above, the guide channels within which axle 56 moves are preferably formed of wire frames 74 and 74', which preferably are shaped as illustrated in FIGS. 4A and 4B. The channels formed by U-shaped wire frames 74 and 74' are dimensioned to allow axle 56 to undergo translational and rotational movement therewithin. As illustrated in FIG. 4A, wire frames 74 and 74' have two bends, with the lower bend being in a direction so that axle 56 moves downward at a more rapid rate as the diameter of roll-of-plastic-bags 52 decreases. Moreover, as the diameter of roll-of-plastic-bags 52 is reduced due to bags being dispensed, the direction of translational movement of axle 56 becomes more acute with respect to the surface of peripheral brake plates 78 and 78' which roll-of-plastic-bags 52 contacts. In this manner, the weight of roll-of-plastic-bags 52, alone or together with downward and/or outward pulling forces applied by the users pulling off bags, causes roll-of-plastic-bags 52 and axle 56 to be "wedged" more tightly into dispenser 63, i.e., producing greater force per unit weight of roll-of-plastic-bags 52. The wedging action is desirable, because the amount of rotation of roll-of-plastic-bags 20, as well as the rate of rotation of roll-of-plastic-bags 20, increases as the circumference of roll-of-plastic-bags 20 becomes smaller, resulting in the potential for greater freewheeling, which is highly undesirable. The increasing wedging action causes a higher frictional force (based on weight of roll-of-plastic-bags 52) between the circumferential surface of roll-of-plastic-bags 52 and peripheral brake plates 78 and 78'. The result of the increasing wedging action is control over excessive freewheeling caused by a user pulling a bag off of roll-of-plastic-bags 52.

Lower frame members 80 and 80' are preferably welded to support member 70, as well as to the lower ends of closed end of U-shaped wire frames 74 and 74'. Upper C-shaped frame member 82 is preferably also welded to support member 70, as well as to the upper open ends of U-shaped wire frames 74 and 74'. Together, upper and lower frame members 80, 80', and 82 support U-shaped wire frames 74 and 74', as well as serving as conduits for the force opposing the wedging action of roll-of-plastic-bags 52 in dispenser 63.

In a preferred embodiment, peripheral brake plates 78 and 78' are attached to support member 70. As illustrated in FIGS. 4A and 4C, peripheral brake plates 78 and 78' are formed from metal plates positioned at an angle relative to support member 70. Preferably there is an acute angle between peripheral brake plates 78 and 78' and wire frames 74 and 74', to provide the wedging action for the reduction or elimination of undesirable freewheeling. Peripheral brake plates 78 and 78' are spaced apart such a distance that only the outer edges of circumferential surface 54 of roll-of-plastic-bags 52 is in contact with each brake plate 78 and 78'. In this manner, peripheral brake plates 78 and 78' do not contact the circumference of roll-of-plastic-bags 52 in a region corresponding with centrally-positioned printing on the surface of the bags making up roll-of-plastic-bags 52. In this manner, ink on circumferential surface 54 of roll-of-plastic-bags 52 does not contact dispenser 63. It has been found that if the ink does contact the dispenser, it will transfer to the dispenser, thereby adversely affecting the appearance of the dispenser. The fact that peripheral brake plates 78 and 78' contact only the periphery of the circumferential surface 54 of roll-of-plastic-bags 52, provides a means of avoiding ink transfer from circumferential surface 54 to the dispenser.

Preferably, dispenser 63 further comprises axle restraining members 76 and 76', which restrict the axial movement of axle 26. Axle restraining members 76, 76' are preferably bars attached to the outside of each U-shaped wire frames 74 and 74'. Axle restraining members 76, 76' are positioned for contact with the ends of axle 56, i.e., outward of but parallel to the centerline of the "U" in each of the U-shaped wire frames 74 and 74', respectively. Axle restraining members 76 and 76' are positioned so that they extend upwardly from the base of the closed end of the U-shaped wire frames 74 and 74', i.e., from the bottom of the "U" to the top of the "U". The bottom ends of axle restraining members 76 and 76' are preferably welded to the bottom outside surface of U-shaped wire frames 74 and 74', respectively. The top ends of axle restraining members 76 and 76' are preferably welded to the inside surface of upper top portions 84 and 84' of U-shaped wire frames 74 and 74', respectively.

Preferably, axle restraining members 76 and 76' are positioned to be slightly spaced from the ends of axle 56 at the upper end of the channel, for receiving a full roll-of-plastic-bags 52. Preferably, restraining members 76 and 76' are positioned to provide a width greater than the axle length at the open upper ends of the channels, with the axle restraining members providing less and less width as axle 56 moves downward toward the closed lower ends of the channels. That is, as roll-of-plastic-bags 52 decreases in diameter due to depletion of the bags, axle 56 travels downward through the channels formed by U-shaped wire frames 74 and 74'. In doing so, the ends of axle 56 come into frictional contact with axle restraining members 76 and 76'. Axle restraining members 76 and 76' serve to prevent bouncing of axle 56 (and associated roll-of-plastic-bags 52) within the channels as the diameter of roll-of-plastic-bags 52 gets smaller. Axle restraining members 76 and 76' also supplement brake plates 78 and 78' in providing additional friction to reduce or eliminate freewheeling of the roll-of-plastic-bags 52 as the diameter of roll-of-plastic-bags 52 diminishes due to depletion.

Dispenser 63 is provided with a upper tongue 68 spaced apart from and attached to support member 70 in a predetermined position corresponding to the predetermined position of centrally-located slit 46 in tear line 44 separating the bags on roll-of-plastic-bags 52. Upper tongue 68 is preferably constructed of metallic wire, preferably stainless steel, preferably having a diameter of about one eighth inch. Upper tongue 68 is attached to wire bracket 86, the ends of which are in turn extended from (or extensions of) lower frame ember 80. Bracket 86 extends outward and somewhat downward, away from bracket 80. See FIG. 4B. The double tongue member has upper triangular tongue 68 and lower triangular tongue 88, which are integral with one another as a diamond shaped wire which is attached to (preferably welded to) bracket 86. See FIGS. 4A, 4B, and 4C. Upper tongue 68 is dimensioned so that as first bag 64 is pulled outward and across upper tongue 68, upper tongue 68 penetrates slit 46 in the bag. Preferably the dispenser has a double tongue, i.e., preferably the tongue has upper tongue 68 (preferably of triangular shape in the embodiment of FIGS. 4A, 4B, and 4C) and lower tongue 88 (also preferably triangular in these embodiments), so that bags may be dispensed by being pulled across and over upper tongue 68 or pulled across and under lower tongue 88. While upper tongue 68 is illustrated in FIG. 4B in a more or less vertical orientation, lower tongue 88 is illustrated as being bent inwardly, i.e., towards support member 70. The "over-under" design of upper tongue 68 and lower tongue 88 permits bags to be either pulled downward (from a dispenser installed relatively high, e.g., above a produce counter in a grocery store) or pulled upward (from a dispenser installed relatively low, e.g., at the level of a candy-counter in a grocery store). In order to accommodate a variety of orientations for bag dispenser 63, bracket 86 may be angled differently (relative to vertical) in order to better allow slit 46 to engage upper tongue 68. In this manner, dispenser 63 may be mounted vertically, horizontally, or in another position by simply changing the angle of either upper tongue 68 or lower tongue 88.

In operation of dispensing system 60 as illustrated in FIGS. 4A, 4B, and 4C, a user grabs a bag extending from roll 52 immediately upstream of upper tongue 68, and pulls the bag over or upper tongue 68, with the resistance to the turning of roll 52 causing a tension in the bag being dispensed. As the bag is forwarded, this tension assists in ensuring that upper tongue 68 snags the continuous web by penetrating slit 46. Further rotation of roll-of-plastic-bags 52 stops when tongue 52 snags slit 46. Further pulling by the user causes tearing of the bag along perforation line 44 as upper tongue 68 prevents further rotation of roll of plastic bags 52. In this manner, the most downstream bag is dispensed by the dispensing system acting in cooperation with the manual actions of the consumer.

FIG. 5 illustrates a continuous web 90 of interconnected, folded handle bags 92 in lay-flat configuration. Handle bags 92 are produced in the same manner as described above in the discussion of the folded bag of FIG. 1, i.e., by the process illustrated in FIGS. 2A–2D also described above, except that in an additional step an upper portion of the folded film is cut away and removed, leaving handles 94 and 96 on either side of the bag. Perforations 100 extend across the entirety of a line separating handle bags 92. Gap 102 between handles 94 and 96 provides a lengthwise "slot" for catching in the tongue of the dispenser, to aid in the individual separation and dispensing of the handle bags 92. As a handle bag 92 is pulled from a roll of handle bags, the tongue is positioned in slot 102, eventually snagging on the upper bag edge 104. In this manner, a roll of bags, and dispensing system, can be used to dispense bags having a pair of handles from a roll of bags in which the bags are individually interconnected.

FIG. 6 illustrates alternative feature which can be used in the dispensing system in accordance with the present invention. FIG. 6 illustrates an alternative paired tongue-and-finger which can be substituted for tongue member 62 in FIGS. 4A, 4B, and 4C. More particularly, paired tongue-and-finger illustrated in FIG. 6 comprises tongue 106 and finger 108, with gap 112 therebetween. Tongue 106 extends upward above finger 108, so that tongue 106 snags the slit or slot between the bags. While further pulling by the consumer tears downstream bag 64 off of next upstream bag 66 by propagating a tear along the line of perforations between the bags, the downstream end of bag 66 is retained in gap 112 between tongue 106 and finger 108. Preferably a downstream surface of finger 108 has teeth 110 thereon, the teeth being designed to hold the downstream end of bag 66 with minimum force for extrication of bag 66 from gap 112, avoiding damage to bag 66. The tongue-and-finger combination is described in U.S. Pat. No. 5,558,262, which is hereby incorporated by reference thereto, in its entirety. The tongue-and-finger combination can be used with just one upstanding tongue member, or with a double tongue member, in which each of the doubled tongues would have a finger associated therewith.

Alternatively, the C-folded roll of bags can be dispensed utilizing a dispenser as disclosed in U.S. Ser. No. 09/641,739, to Kannankeril et al., entitled "Pivoting Arm Bag Dispenser And Bag Dispensing System", filed Aug. 18, 2000, which is also hereby incorporated in its entirety by reference thereto. A tongue-and-finger combination as illustrated in FIG. 6, and as described above, can also be used with the pivoting arm dispenser.

Although the C-folded bags are preferably present on the roll as a continuous strand of interconnected bags separated from one another by a line of perforations and a centrally-located slit, as an alternative the C-folded bags can instead be rolled into a roll in separated, interleaved fashion in the manner disclosed in copending U.S. Ser. No. 09/641,739, to Kannankeril et al., entitled "Interleaved Roll Of Plastic Bags And Dispensing System Using Same", filed Aug. 18, 2000, which is also hereby incorporated in its entirety by reference thereto. Of course, as disclosed in the interleaved roll application, the dispenser used to dispense the bags need not have a tongue or finger if a roll of interleaved bags is utilized.

It will be apparent to those skilled in the art that many modifications and substitutions can be made to the foregoing preferred embodiment without departing from the spirit and scope of the present invention, which is defined by the appended claims.

What is claimed is:

1. A wound roll of plastic bags comprising a continuous web of folded, flattened bags joined along perforated severance lines, the bags further comprising:

(A) first, second, and third longitudinal folds which form a first gusset;

(B) fourth, fifth and sixth longitudinal folds which form a second gusset;

(C) a seventh longitudinal fold which is on a side of the bag containing the first, second, and third folds, the seventh fold forming a first folded bag flap;

(D) an eighth longitudinal fold which is on a side of the bag containing the fourth, fifth and sixth folds, the eighth fold forming a second folded bag flap, the combined width of the two flaps being no greater than the distance between the seventh and eighth folds, with the bag being folded into a total of at least eight contiguous plies; and (E) an opening in each severance line which is adapted to engage the separating tongue of a bag dispenser so that each individual bag can be separated from the roll.

2. A wound roll of plastic bags according to claim 1, wherein each opening is formed by a central cut-out region which forms handles in the sides of each bag.

3. A wound roll of plastic bags according to claim 1, wherein the flaps are folded inwardly to form a C-fold.

4. A wound roll of plastic bags according to claim 3, wherein each opening is formed by a cut-out region which forms handles in the sides of the bag.

5. A bag dispensing system for serially dispensing plastic bags, comprising:

(A) a wound roll of plastic bags comprising a continuous web of folded, flattened bags joined along perforated severance lines, the bags further comprising:

(i) first, second, and third longitudinal folds which form a first gusset;

(ii) fourth, fifth and six longitudinal folds which form a second gusset;

(iii) a seventh longitudinal fold which is on a side of the bag containing the first, second and third folds, the seventh fold forming a first folded bag flap;

(iv) an eighth longitudinal fold which is on a side of the bag containing the fourth, fifth and sixth folds, the eighth fold forming a second folded bag flap, the combined width of the two flaps being no greater than the distance between the seventh and eighth folds, with the bag being folded into a total of at least eight contiguous plies; and (v) an opening in each severance line which is adapted to engage the separating tongue of a bag dispenser so that each individual bag can be separated from the roll, with the bags being folded into a total of at least eight contiguous plies; and (B) a dispenser comprising a support member for attachment to a support surface, means for rotatably supporting the wound roll of plastic bags for rotation of the wound roll during dispensing and separating bags therefrom, and a separating tongue for separating the plastic bags from the wound roll, the tongue being spaced apart from and carried by the support member in a predetermined position corresponding to the location of the opening; and wherein the wound roll of plastic bags is positioned in the dispenser so that upon pulling a bag to be separated, the opening catches on the tongue, with further pulling causing the bag to be separated to tear free of an adjacent bag.

6. A bag dispensing system according to claim 5, wherein each opening is formed by a cut-out region which forms handles in the sides of the bag.

7. A bag dispensing system according to claim 5, wherein the flaps are folded inwardly to form a C-fold.

8. A bag dispensing system according to claim 7, wherein each opening is formed by a central cut-out region which forms handles in the sides of the bag.

* * * * *